US007263731B1

(12) United States Patent
Stepanek et al.

(10) Patent No.: US 7,263,731 B1
(45) Date of Patent: Sep. 4, 2007

(54) SLEEPING BAG HAVING MATTRESS AND CANOPY

(76) Inventors: Steven G. Stepanek, 2358 180th Ave., Manchester, IA (US) 52057; Darla J. Stepanek, 2358 180th Ave., Manchester, IA (US) 52057

( * ) Notice: Subject to any disclaimer, the term of this patent is extended or adjusted under 35 U.S.C. 154(b) by 0 days.

(21) Appl. No.: 11/319,955

(22) Filed: Dec. 29, 2005

(51) Int. Cl.
*A47G 9/08* (2006.01)
*E04H 15/58* (2006.01)

(52) U.S. Cl. ..... 5/413 R; 5/414; 135/116

(58) Field of Classification Search ..... 5/413 R, 5/413 AM, 414; 135/116
See application file for complete search history.

(56) References Cited

U.S. PATENT DOCUMENTS 3,334,363 A 8/1967 Lutz
3,751,741 A * 8/1973 Hendry ..... 5/413 AM
4,605,029 A * 8/1986 Russell ..... 135/125
4,757,832 A * 7/1988 Russell ..... 135/128
4,862,533 A 9/1989 Adams, III
5,257,427 A 11/1993 Hinshaw
D348,348 S 7/1994 Lawson
5,528,779 A * 6/1996 Lee et al. ..... 5/413 AM
6,321,400 B1 * 11/2001 Gulino ..... 5/413 AM
6,675,414 B2 1/2004 Lamke
D489,929 S 5/2004 Sherk
7,127,753 B1 * 10/2006 Ramaley ..... 5/413 R

* cited by examiner

*Primary Examiner*—Michael Trettel
(74) *Attorney, Agent, or Firm*—Donald R. Schoonover

(57) ABSTRACT

A camping apparatus having a sleeping bag with a length and a width, cushioning means secured to the bottom of the sleeping bag; and sheltering means having a width greater than the length of the sleeping bag and a length greater than the width of the sleeping bag. The sheltering means includes a canopy, supporting means for operably supporting the canopy above the sleeping bag, and storage means for storing the sheltering means on the sleeping bag.

18 Claims, 1 Drawing Sheet

SLEEPING BAG HAVING MATTRESS AND CANOPY

BACKGROUND OF THE INVENTION

1. Field of the Invention

The present invention relates to sporting goods and, more specifically without limitation, to camping equipment.

2. Description of the Related Art

During the warm summer months, millions of people flock to the outdoors to soak up the sun's rays. These individuals often participate in a variety of recreational activities that allow them to further enjoy their time outdoor. Some of these activities include swimming, hiking, biking, running, boating, and enjoying as picnic in the park. One of the most popular summertime activities, however, is camping. Camping allows individuals to go back to nature and enjoy life away from the stress of work and home. It also allows families to draw closer together as they are basically forced to communicate with and entertain each other because of the absence of television and other worldly attractions.

A fair amount of equipment is needed when camping in order to stay safe, comfortable, and warm. The type of gear a person may bring while camping depends on how rough of an experience the individual desires. Tents, cookware, matches, portable stoves, flashlights, lanterns, and sleeping bags are just some of the equipment from which a camper may choose.

Sleeping bags are generally an essential piece of equipment, especially when a tent is not used. Sleeping bags can provide considerable warmth, but can still prove to make sleeping outdoors fairly uncomfortable. A person may put an air mattress under the sleeping bag to cushion his or her back from the rough and rocky ground beneath.

The use of an air mattress adds to the amount of equipment a person is already transporting, causing the individual to seek out other methods of cushioning themselves from the hard ground. In addition, taking various types of equipment that are specific to a particular camper may cause the camper to lighten his load by foregoing the use of a tent, which would eliminate the covering protection, such as rain, falling leaves or acorns, etc., that would otherwise be provided by a tent.

What is needed is a sleeping bag having a built-in air mattress. What is also needed is a sleeping bag having a built-in canopy.

PRINCIPAL OBJECTS AND ADVANTAGES OF THE INVENTION

The principal objects and advantages of the present invention include: providing a sleeping bag having a built-in air mattress; providing a sleeping bag having a built-in canopy; and generally providing such an air mattress that is reliable in performance, capable of long lasting life, and particularly well adapted for the proposed usages thereof.

Other objects and advantages of this invention will become apparent from the following description taken in conjunction with the accompanying drawings wherein are set forth, by way of illustration and example, certain embodiments of this invention.

SUMMARY OF THE INVENTION

The improvements of the sleeping bag having mattress and canopy of the present invention include a sleeping bag, cushioning means, sheltering or canopy means, and sleeping bag anchoring means.

The sleeping bag has an overall length dimension and an overall width dimension and includes an upper portion having an upper head edge, an upper foot edge, an upper first side edge, and an upper second side edge; a lower portion having a lower outer side, a lower head edge, a lower foot edge, a lower first side edge connected to the upper first side edge of the upper portion, and a lower second side edge; and sleeping bag fastening means for releasably securing the upper foot edge of the upper portion of the sleeping bag to the lower foot edge of the lower portion of the sleeping bag and for releasably securing the upper second side edge of the upper portion of the sleeping bag to the lower second side edge of the lower portion of the sleeping bag.

The cushioning means is secured to the lower outer side of the lower portion of the sleeping bag and includes a flexible panel that generally extends from the lower head edge of the lower portion of the sleeping bag to the lower foot edge of the lower portion of the sleeping bag. The panel has a panel first side edge connected to the lower first side edge of the lower portion of the sleeping bag, a panel second side edge connected to the lower second side edge of the lower portion of the sleeping bag, a panel first end edge connected to the lower foot edge of the lower portion of the sleeping bag, and a panel second end edge releasably connected to the lower head edge of the lower portion of the sleeping bag such that a compartment is formed adjacent to the lower outer side of the lower portion of the sleeping bag.

The cushioning means also includes a resilient device, such as an inflatable air mattress or foam pad, removably disposed within the compartment.

The sheltering or canopy means, which has an overall width dimension that is greater than the overall length dimension of the sleeping bag, includes a canopy having a flexible first canopy portion having a first proximal edge secured to the upper first side edge of the upper portion of the sleeping bag, a first distal edge, a first head edge, and a first foot edge.

The canopy also includes a flexible second canopy portion having a length dimension greater than the overall width dimension of the sleeping bag, the second canopy portion further having a second proximal edge secured to the first distal edge of the first canopy portion, a second distal edge, a second head edge, a second foot edge, and a canopy portion outer surface.

The canopy further includes a flexible first wing portion having a first wing proximal edge, connected to the first head edge of the first canopy portion, and a first wing distal edge, and a flexible second wing portion having a second wing proximal edge, connected to the first foot edge of the first canopy portion, and a second wing distal edge.

The sheltering means also includes supporting means, which is structured to operably supporting the canopy above the sleeping bag, having first poles each having a first length dimensioned to support the first distal edge of the first canopy portion and the second proximal edge of the second canopy portion above the sleeping bag, second poles each having a second length dimensioned to support the second distal edge of the second canopy portion above the sleeping bag wherein the first length of the first poles is greater than the second length of the second poles, and stakes and cords for operably bracing and anchoring the first and second poles of the canopy means. The first poles are installable alongside the first and second wing distal edges of the canopy means.

The sheltering or canopy means further includes storage means, which is structured to store the canopy means on the sleeping bag, having a first storage connecting portion secured to the canopy portion outer surface wherein the first storage connecting portion extends from the second head edge to the second foot edge of the second canopy portion and the first storage connecting portion is located alongside the second proximal edge of the second canopy portion, and having a second storage connecting portion spaced along the upper second side edge of the upper portion of the sleeping bag that extends from near the upper head edge of the upper portion of the sleeping bag to near the upper foot edge of the upper portion of the sleeping bag.

The sleeping bag anchoring means includes two or more loops secured to the lower portion of the sleeping bag; and anchoring devices structured to operably secure the two or more loops to an underlying supporting surface.

DETAILED DESCRIPTION OF THE INVENTION

As required, embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

Figure 1:
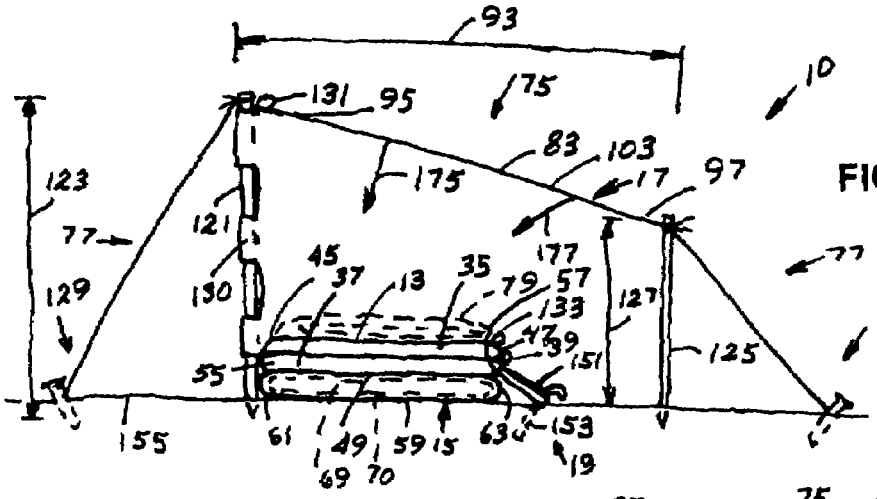
FIG. 1 is an end elevational view of a sleeping bag having a cushioning device and sheltering means, in accordance with the present invention.
Figure 2:
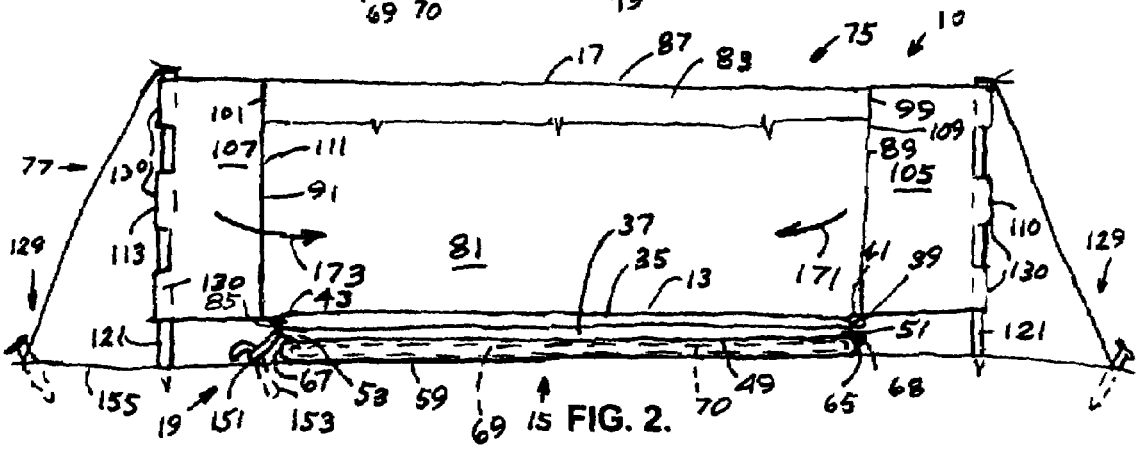
FIG. 2 is a side elevational view taken along line 2-2 of FIG. 1, of the sleeping bag having a cushioning device and sheltering means.
Figure 3:
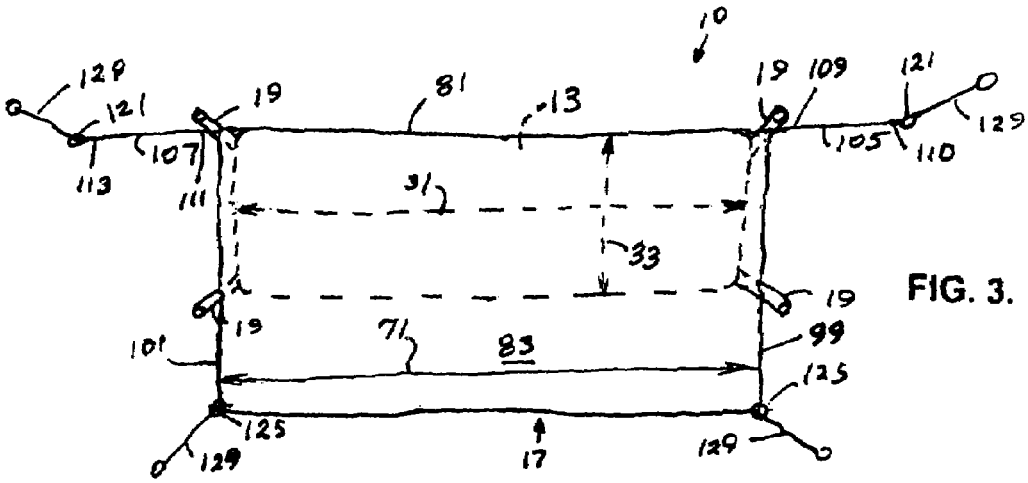
FIG. 3 is a top plan view of the sleeping bag having a cushioning device and sheltering means, in accordance with the present invention.
Figure 1:
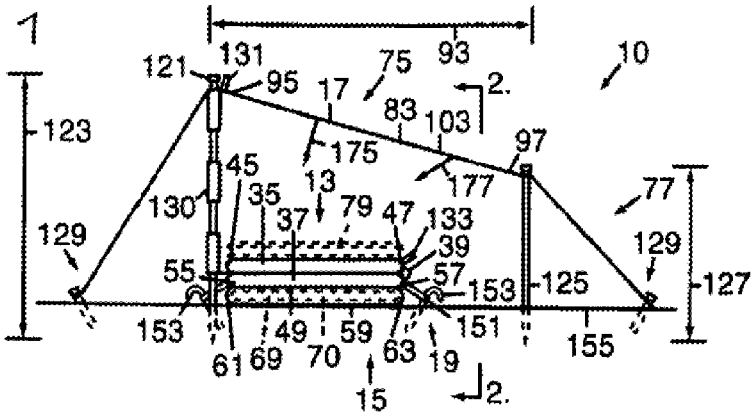
Figure 2:
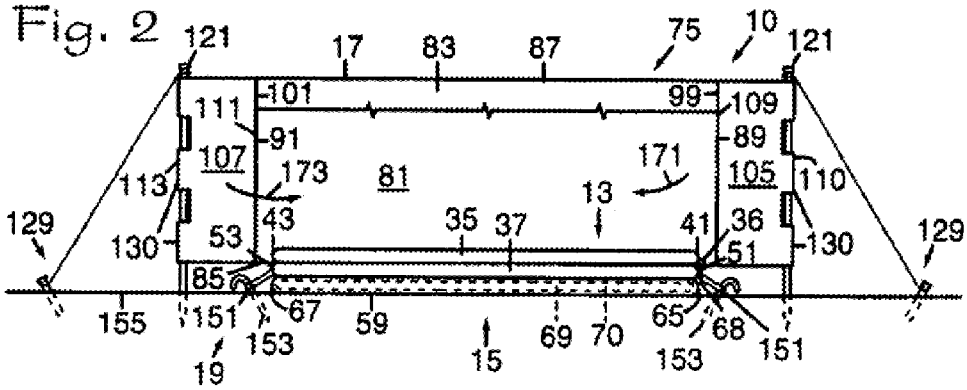
Figure 3:
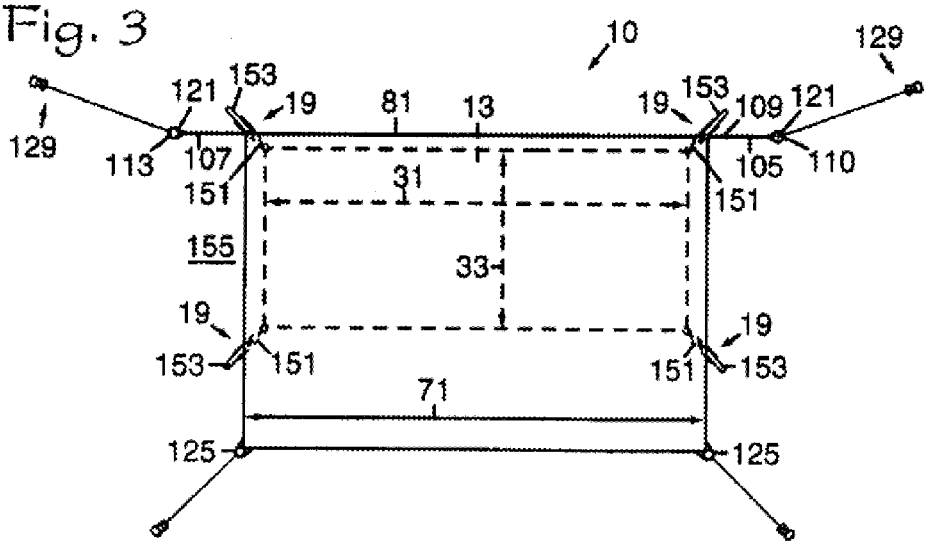

The reference numeral 10 generally refers to a camping apparatus in accordance with the present invention, as shown in FIGS. 1 through 3. The camping apparatus 10 includes a sleeping bag 13, cushioning means 15, sheltering means 17, and sleeping bag anchoring means 19.

The sleeping bag 13, which has an overall length dimension 31 and an overall width dimension 33, includes an upper portion 35, a lower portion 37, and sleeping bag fastening means 39. The upper portion 35 has an upper head edge 41, an upper foot edge 43, an upper first side edge 45, and an upper second side edge 47.

The lower portion 37 has a lower outer side 49, a lower head edge 51, a lower foot edge 53, a lower first side edge 55 connected to the upper first side edge 45 of the upper portion 35, and a lower second side edge 57.

The sleeping bag fastening means 39, such as a zipper 39 for example, releasably secures the upper foot edge 43 of the upper portion 35 of the sleeping bag 13 to the lower foot edge 53 of the lower portion 37 of the sleeping bag 13, and releasably secures the upper second side edge 47 of the upper portion 35 of the sleeping bag 13 to the lower second side edge 57 of the lower portion 37 of the sleeping bag 13.

The cushioning means 15, which is secured to the lower outer side 49 of the lower portion 37 of the sleeping bag 13, includes a flexible panel 59 that generally extends from the lower head edge 51 of the lower portion 37 of the sleeping bag 13 to the lower foot edge 53 of the lower portion 37 of the sleeping bag 13. The panel 59 includes a panel first side edge 61 connected to the lower first side edge 55 of the lower portion 37 of the sleeping bag 13, a panel second side edge 63 connected to the lower second side edge 57 of the lower portion 37 of the sleeping bag 13, a panel first end edge 65 connected to the lower foot edge 53 of the lower portion 37 of the sleeping bag 13, and a panel second end edge 67 releasably connected to the lower head edge 51 of the lower portion 37 of the sleeping bag 13 by closure means 68 such as a zipper for example, wherein a compartment 69 is formed adjacent to the lower outer side 49 of the lower portion 37 of the sleeping bag 13.

The cushioning means 15 also includes a resilient device 70 such as an inflatable air mattress 70 or a foam pad 70 for example, that is removably disposed within the compartment 69. If desired, the resilient device 70 may have an enlarged, pillow-type feature at the end nearest the lower head edge 51 of the lower portion 37 of the sleeping bag 13.

The sheltering means 17, which operably has a width dimension 71 that is greater than the overall length dimension 31 of the sleeping bag 13, includes a canopy 75, supporting means 77 for operably supporting the canopy 75 above the sleeping bag 13, and storage means (indicated by the broken lines designated by the numeral 79 in FIG. 1) for storing the sheltering means 17 on the sleeping bag 13.

The canopy 75 includes a flexible first canopy portion 81 and a flexible second canopy portion 83. The first canopy portion 81 has a first proximal edge 85 secured to the upper first side edge 45 of the upper portion 35 of the sleeping bag 13, a first distal edge 87, a first head edge 89, and a first foot edge 91. The second canopy portion 83, which operably has a horizontally extending dimension 93 that is greater than the overall width dimension 33 of the sleeping bag 13, includes a second proximal edge 95 that is secured to the first distal edge 87 of the first canopy portion 81, a second distal edge 97, a second head edge 99, a second foot edge 101, and a canopy outer surface 103.

The canopy 75 also includes a flexible first wing portion 105 and a flexible second wing portion 107. The first wing portion 105 includes a first wing proximal edge 109, connected to the first head edge 89 of the first canopy portion 81, and a first wing distal edge 110.

The second wing portion 107 includes a second wing proximal edge 111, connected to the first foot edge 91 of the first canopy portion 81, and a second wing distal edge 113.

The supporting means 77, which is structured to operably support the canopy 75 above the sleeping bag 13, includes first poles 121, each having a first pole length 123 that is dimensioned to support the first distal edge 87 of the first canopy portion 81 and the second proximal edge 95 of the second canopy portion 83 above the sleeping bag 13.

The supporting means 77 also includes second poles 125, each having a second pole length 127 that is dimensioned to support the second distal edge 97 of the second canopy portion 83 above the sleeping bag 13, wherein the first pole length 123 of the first poles 121 is greater than the second pole length of the second poles 125.

The supporting means 77 further includes stakes and cords 129 for operably bracing and anchoring the first and second poles 121, 125 of the sheltering means 17. The first poles 121 are operably installed alongside the first and second wing distal edges 110, 113 of the canopy 75. If desired, each of the first and second wing distal edges 110, 113 may include one or more edge loops 130 to receive a respective first pole 121 therethrough for purposes of added stability and for reducing possible wind-flapping noise.

The storage means 79 includes a first storage connecting portion 131, such as one side of a zipper for example, secured to the canopy portion outer surface 103 and extending from the second head edge 99 to the second foot edge 101 of the second canopy portion 83. The first storage connecting portion 131 is located alongside the second proximal edge 95 of the second canopy portion 83.

The storage means 79 also includes a second storage connecting portion 133, such as the other side of a zipper for example, spaced along the upper second side edge 47 of the upper portion 35 of the sleeping bag 13 and extending from near the upper head edge 41 of the upper portion 35 of the sleeping bag 13 to near the upper foot edge 43 of the upper portion 35 of the sleeping bag 13.

The sleeping bag anchoring means 19 includes two or more loops 151 secured to the lower portion 37 of the sleeping bag 13, and anchoring devices 153 to operably secure the two or more loops 151 to an underlying supporting surface 155.

In an application of the present invention, the sleeping bag 13 is spread out on the underlying supporting surface 155 with the compartment 69 spaced between the lower portion 37 of the sleeping bag 13 and the underlying supporting surface 155. The cushioning means 15 is positioned within the compartment 69. If the cushioning means 15 includes an air mattress, the air mattress is inflated, such as by mouth, mechanical hand pump, electric air pump, compressor, or other suitable means. The cushioning means 15 is confined to the compartment 69 by closing the compartment 69 with the closure means 68. The sleeping bag 13 is then anchored to the underlying supporting surface 155 with the sleeping bag anchoring means 19.

The sheltering means 17 is then unfolded from its storage on the upper portion 35 of the sleeping bag 13 as described herein by releasing the first and second storage connecting portions 131, 133. The first poles 121 are then erected generally vertically along the first and second wing distal edges 110, 113 of the first and second wing portions 105, 107. Similarly, the second poles 125 are erected generally vertically at the intersections of the second head and foot edges 99, 101 of the second canopy portion 83 with the second distal edge 97 of the second canopy portion 83. The stakes and cords 129, and placement of the first and second poles 121, 125 in conjunction therewith, are operably arranged such that the first canopy portion 81 is tautly spaced upwardly from the sleeping bag 13, the first and second wing portions 105, 107 are tautly spaced outwardly from the first canopy portion 81, and the second canopy portion 83 is tautly spaced between the first and second poles 121, 125.

When breaking camp, the cushioning means 15 is deflated (if necessary) and the arrangement of the first and second poles 121, 125 and the stakes and cords 131 are disassembled. The first and second wing portions 105, 107 are folded inwardly to be spaced alongside the first canopy portion 81 as indicated by the arrows designated by the numerals 171, 173, and the second canopy portion 83 is then folded inwardly to be spaced between the first canopy portion 81 and the upper portion 35 of the sleeping bag 13 as indicated by the arrows designated by the numerals 175, 177. The storage means 79 is then provided by releasably connecting the first storage connecting portion 131 to the second storage connecting portion 133. The sleeping bag anchoring means 19 is then disassembled to release the sleeping bag 13 from being anchored to the underlying surface 155. Finally, the sleeping bag 10 is customarily rolled up for ease of transportation.

It is to be understood that while certain forms of the present invention have been illustrated and described herein, it is not to be limited to the specific forms or arrangement of parts as described and shown.

What is claimed and desired to be covered by Letters Patent is:

1. A camping apparatus, comprising:

(a) a sleeping bag having an overall length dimension and an overall width dimension, the sleeping bag including:

(1) an upper portion having an upper head edge, an upper foot edge, an upper first side edge, and an upper second side edge, (2) a lower portion having a lower outer side, a lower head edge, a lower foot edge, a lower first side edge connected to the upper first side edge of the upper portion, and a lower second side edge, and (3) sleeping bag fastening means releasably securing the upper foot edge of the upper portion of the sleeping bag to the lower foot edge of the lower portion of the sleeping bag and releasably securing the upper second side edge of the upper portion of the sleeping bag to the lower second side edge of the lower portion of the sleeping bag;

(b) cushioning means secured to the lower outer side of the lower portion of the sleeping bag; and (c) sheltering means having an overall width dimension greater than the overall length dimension of the sleeping bag, the sheltering means including:

(1) a canopy including:

(A) a flexible first canopy portion having a canopy outer surface, a first proximal edge secured to the upper first side edge of the upper portion of the sleeping bag, a first distal edge, a first head edge, and a first foot edge, and (B) a flexible second canopy portion having a length dimension greater than the overall width dimension of the sleeping bag, the second canopy portion further having a second proximal edge secured to the first distal edge of the first canopy portion, a second distal edge, a second head edge, a second foot edge, and a canopy portion outer surface, (2) supporting means for operably supporting the canopy above the sleeping bag, and (3) storage means for storing the sheltering means on the sleeping bag.

2. A camping apparatus as described in claim 1, wherein the cushioning means includes:

(a) a flexible panel generally extending from the lower head edge of the lower portion of the sleeping bag to the lower foot edge of the lower portion of the sleeping bag, the panel having a panel first side edge connected to the lower first side edge of the lower portion of the sleeping bag and a panel second side edge connected to the lower second side edge of the lower portion of the sleeping bag, such that a compartment is formed adjacent to the lower outer side of the lower portion; and (b) a resilient device removably disposed within the compartment.

3. A camping apparatus as described in claim 2, wherein the resilient device includes a foam pad.

4. A camping apparatus as described in claim 2, wherein the resilient device includes an inflatable air mattress.

5. A camping apparatus as described in claim 2, further comprising:

(a) the flexible panel having a panel first end edge and a panel second end edge, wherein the panel first end edge is connected to the lower foot edge of the lower portion of the sleeping bag; and (b) a second fastening means releasably securing the panel second end edge to the lower head edge of the lower portion of the sleeping bag.

6. A camping apparatus as described in claim 1, wherein the canopy means further includes:

(a) a flexible first wing portion having a first wing proximal edge, connected to the first head edge of the first canopy portion, and a first wing distal edge, and (b) a flexible second wing portion having a second wing proximal edge, connected to the first foot edge of the first canopy portion, and a second wing distal edge.

7. A camping apparatus as described in claim 1, wherein the supporting means includes:

(a) first poles, each having a first length dimensioned to support the first distal edge of the first canopy portion and the second proximal edge of the second canopy portion above the sleeping bag, and (b) second poles, each having a second length dimensioned to support the second distal edge of the second canopy portion above the sleeping bag wherein the first length of the first poles is greater than the second length of the second poles.

8. A camping apparatus as described in claim 7, wherein the first poles are operably installed alongside the first and second wing distal edges.

9. A camping apparatus as described in claim 7, wherein each of the first and second wing distal edges includes at least one vertically oriented loop for inserting a respective one of the first poles therethrough.

10. A camping apparatus as described in claim 7, wherein the supporting means includes stakes and cords for operably bracing and the first and second poles of the canopy means.

11. A camping apparatus as described in claim 7, wherein the first poles are approximately thirty-eight inches in length.

12. A camping apparatus as described in claim 7, wherein the second poles are approximately twenty-four inches in length.

13. A camping apparatus as described in claim 7, wherein the first and second poles are telescopically collapsible to approximately twelve inches in length.

14. A camping apparatus as described in claim 1, wherein the storage means includes:

(a) a first storage connecting portion secured to the canopy outer surface, the first storage connecting portion extending from the second head edge to the second foot edge of the second canopy portion, and (b) a second storage connecting portion spaced along the upper second side edge of the upper portion of the sleeping bag and extending from near the upper head edge of the upper portion of the sleeping bag to near the upper foot edge of the upper portion of the sleeping bag.

15. A camping apparatus as described in claim 14, wherein the first storage connecting portion is located alongside the second proximal edge of the second canopy portion.

16. A camping apparatus as described in claim 1, further comprising sleeping bag anchoring means.

17. A camping apparatus as described in claim 16, wherein the sleeping bag anchoring means includes:

(a) two or more loops secured to the lower portion of the sleeping bag; and (b) anchoring devices to operably secure the two or more loops to an underlying supporting surface.

18. A camping apparatus, comprising:

(a) a sleeping bag having an overall length dimension and an overall width dimension, the sleeping bag including:

(1) an upper portion having an upper head edge, an upper foot edge, an upper first side edge, and an upper second side edge, (2) a lower portion having a lower outer side, a lower head edge, a lower foot edge, a lower first side edge connected to the upper first side edge of the upper portion, and a lower second side edge, and (3) sleeping bag fastening means releasably securing the upper foot edge of the upper portion of the sleeping bag to the lower foot edge of the lower portion of the sleeping bag and releasably securing the upper second side edge of the upper portion of the sleeping bag to the lower second side edge of the lower portion of the sleeping bag;

(b) cushioning means secured to the lower outer side of the lower portion of the sleeping bag, the cushioning means including:

(1) a flexible panel generally extending from the lower head edge of the lower portion of the sleeping bag to the lower foot edge of the lower portion of the sleeping bag, the panel having a panel first side edge connected to the lower first side edge of the lower portion of the sleeping bag, a panel second side edge connected to the lower second side edge of the lower portion of the sleeping bag, a panel first end edge connected to the lower foot edge of the lower portion of the sleeping bag, and a panel second end edge releasably connected to the lower head edge of the lower portion of the sleeping bag such that a compartment is formed adjacent to the lower outer side of the lower portion of the sleeping bag; and (2) an inflatable air mattress removably disposed within the compartment;

(c) sheltering means having a width dimension greater than the overall length dimension of the sleeping bag, the sheltering means including:

(1) a canopy, including:

(A) a flexible first canopy portion having a first proximal edge secured to the upper first side edge of the upper portion of the sleeping bag, a first distal edge, a first head edge, and a first foot edge, (B) a flexible second canopy portion operably having a horizontally extending dimension greater than the overall width dimension of the sleeping bag, the second canopy portion further having a second proximal edge secured to the first distal edge of the first canopy portion, a second distal edge, a second head edge, a second foot edge, and a canopy outer surface, (C) a flexible first wing portion having a first wing proximal edge, connected to the first head edge of the first canopy portion, and a first wing distal edge, and (D) a flexible second wing portion having a second wing proximal edge, connected to the first foot edge of the first canopy portion, and a second wing distal edge, (2) supporting means for operably supporting the canopy above the sleeping bag, the supporting means including:

(A) first poles, each having a first pole length dimensioned to support the first distal edge of the first canopy portion and the second proximal edge of the second canopy portion above the sleeping bag, (B) second poles, each having a second pole length dimensioned to support the second distal edge of the second canopy portion above the sleeping bag wherein the first pole length of the first poles is greater than the second pole length of the second poles, and (C) stakes and cords for operably bracing and anchoring the first and second poles of the canopy means, and (D) wherein the first poles are installable alongside the first and second wing distal edges, and (3) storage means for storing the canopy on the sleeping bag, the storage means including:

(A) a first storage connecting portion secured to the canopy portion outer surface, the first storage connecting portion extending from the second head edge to the second foot edge of the second canopy portion, the first storage connecting portion being located alongside the second proximal edge of the second canopy portion, and (B) a second storage connecting portion spaced along the upper second side edge of the upper portion of the sleeping bag and extending from near the upper head edge of the upper portion of the sleeping bag to near the upper foot edge of the upper portion of the sleeping bag; and (d) sleeping bag anchoring means, including:

(1) two or more loops secured to the lower portion of the sleeping bag; and (2) anchoring devices to operably secure the two or more loops to an underlying supporting surface.

* * * * *

UNITED STATES PATENT AND TRADEMARK OFFICE

CERTIFICATE OF CORRECTION

PATENT NO. : 7,263,731 B1
APPLICATION NO. : 11/319955
DATED : September 4, 2007
INVENTOR(S) : Steven G. Stepanek et al.

It is certified that error appears in the above-identified patent and that said Letters Patent is hereby corrected as shown below:

The title page showing an illustrative figure(s) 1and 2 should be deleted and substitute therefore the attached title page consisting of Figs. 1 and 2.

The drawing sheets consisting of Fig(s) 1-3 should be deleted and substitute therefore the attached drawing sheets consisting of Fig(s) 1-3

Signed and Sealed this

Thirteenth Day of May, 2008

JON W. DUDAS
*Director of the United States Patent and Trademark Office*

(12) United States Patent
Stepanek et al.

(10) Patent No.: US 7,263,731 B1
(45) Date of Patent: Sep. 4, 2007

(54) SLEEPING BAG HAVING MATTRESS AND CANOPY

(76) Inventors: Steven G. Stepanek, 2358 180th Ave., Manchester, IA (US) 52057; Darla J. Stepanek, 2358 180th Ave., Manchester, IA (US) 52057

( * ) Notice: Subject to any disclaimer, the term of this patent is extended or adjusted under 35 U.S.C. 154(b) by 0 days.

(21) Appl. No.: 11/319,955

(22) Filed: Dec. 29, 2005

(51) Int. Cl.
*A47G 9/08* (2006.01)
*E04H 15/58* (2006.01)

(52) U.S. Cl. ..... 5/413 R; 5/414; 135/116

(58) Field of Classification Search ..... 5/413 R, 5/413 AM, 414; 135/116
See application file for complete search history.

(56) References Cited

U.S. PATENT DOCUMENTS 3,334,363 A 8/1967 Lutz
3,751,741 A * 8/1973 Hendry ..... 5/413 AM
4,605,029 A * 8/1986 Russell ..... 135/125
4,757,832 A * 7/1988 Russell ..... 135/128
4,862,533 A 9/1989 Adams, III
5,257,427 A 11/1993 Hinshaw
D348,348 S 7/1994 Lawson
5,528,779 A * 6/1996 Lee et al. ..... 5/413 AM
6,321,400 B1 * 11/2001 Gulino ..... 5/413 AM
6,675,414 B2 1/2004 Lamke
D489,929 S 5/2004 Sherk
7,127,753 B1 * 10/2006 Ramaley ..... 5/413 R

* cited by examiner

*Primary Examiner*—Michael Trettel
(74) *Attorney, Agent, or Firm*—Donald R. Schoonover

(57) ABSTRACT

A camping apparatus having a sleeping bag with a length and a width, cushioning means secured to the bottom of the sleeping bag; and sheltering means having a width greater than the length of the sleeping bag and a length greater than the width of the sleeping bag. The sheltering means includes a canopy, supporting means for operably supporting the canopy above the sleeping bag, and storage means for storing the sheltering means on the sleeping bag.

18 Claims, 1 Drawing Sheet

Fig. 1

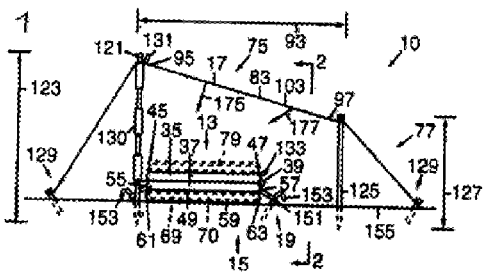

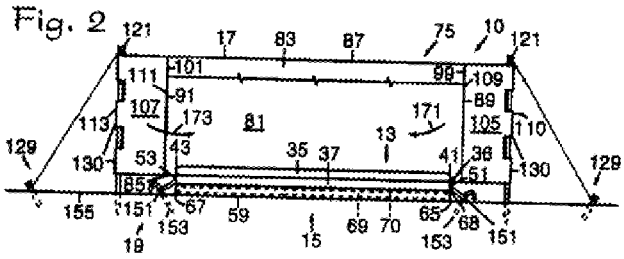

Fig. 2